US008193892B2

(12) United States Patent
Ukawa et al.

(10) Patent No.: US 8,193,892 B2
(45) Date of Patent: Jun. 5, 2012

(54) WIRE-WOUND COIL

(75) Inventors: Yoshiaki Ukawa, Kyoto-fu (JP); Toshikazu Inubushi, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/165,499

(22) Filed: Jun. 21, 2011

(65) Prior Publication Data

US 2011/0248810 A1 Oct. 13, 2011

Related U.S. Application Data

(63) Continuation of application No. PCT/JP2009/007178, filed on Dec. 24, 2009.

(30) Foreign Application Priority Data

Dec. 25, 2008 (JP) ..... 2008-329143

(51) Int. Cl.
*H01F 27/29* (2006.01)

(52) U.S. Cl. ..... 336/192

(58) Field of Classification Search ..... 336/65, 336/192, 198, 200, 232
See application file for complete search history.

(56) References Cited

U.S. PATENT DOCUMENTS

2002/0180574 A1* 12/2002 Toi et al. ..... 336/83

FOREIGN PATENT DOCUMENTS

| | | | |
|---|---|---|---|
| JP | 58-114014 | | 8/1983 |
| JP | 59152611 A | * | 8/1984 |
| JP | 63-089226 | | 6/1988 |
| JP | 05-028005 | | 4/1993 |
| JP | 2004-056112 A | | 2/2004 |
| JP | 2007-027461 A | | 2/2007 |

OTHER PUBLICATIONS

International Search Report; PCT/JP2009/007178; Mar. 23, 2010.
Written Opinion of the International Searching Authority; PCT/JP2009/007178.

* cited by examiner

*Primary Examiner* — Tuyen Nguyen
(74) *Attorney, Agent, or Firm* — Studebaker & Brackett PC; Tim L. Brackett, Jr.; John F. Guay

(57) ABSTRACT

The disclosure provides a wire-wound coil that can prevent contact between an outer flange portion of the wire-wound coil and a mount board so as to prevent breakage of the outer flange portion and misalignment and unwinding of a wound conductive wire. A groove is provided in an outer side face of a flange at an end of a winding core, and an inner flange portion and an outer flange portion are provided on opposite sides of the groove. A distance from a bottom face of the groove to at least an outer side face of the outer flange portion that would be facing a mount board or is attached to a mount board is shorter than a distance from the bottom face of the groove to the inner flange portion.

7 Claims, 4 Drawing Sheets

WIRE-WOUND COIL

CROSS REFERENCE TO RELATED APPLICATIONS

The present application is a continuation of International Application No. PCT/JP2009/007178, filed Dec. 24, 2009, which claims priority to Japanese Patent Application No. 2008-329143 filed Dec. 25, 2008, the entire contents of each of these applications being incorporated herein by reference in their entirety.

TECHNICAL FIELD

The present invention relates to a wire-wound coil in which a conductive wire is wound around a core and which is mounted on a mount board.

BACKGROUND

As antennas incorporated in hearing aids, mobile telephones, etc. and electronic components used for denoising, various types of wire-wound coils have been proposed in which a conductive wire is wound around a winding core and which generate magnetic flux through the application of current to the conductive wire.

For example, a coil component of Japanese Unexamined Utility Model Registration Application Publication No. 58-114014 (Patent Document 1) includes a winding core which is formed by a ferrite core and around which a conductive wire is wound, and flanges provided at opposite ends of the winding core. The flanges have, for example, annular grooves, and an inner flange portion and an outer flange portion are provided on opposite sides of each groove. Further, a wind starting end and a wind ending end of the conductive wire in the winding core are wound and soldered in the grooves of the flanges to form electrodes. The electrodes are soldered to predetermined positions on a mount board, so that the coil component is mounted on the mount board. (See, page 3, lines 5-19, FIG. 3, etc.)

SUMMARY

The disclosure provides a wire-wound coil that can prevent contact between an outer flange portion of the wire-wound coil and a mount board to prevent breakage of the outer flange portion and misalignment and unwinding of a wound conductive wire.

In a disclosed embodiment, a wire-wound coil is mountable to a mount board and includes a winding core around which a conductive wire is wound, and a flange provided at each end of the wired winding core. Each flange includes a groove provided in an outer peripheral surface of the flange, an inner flange portion provided closer to the winding core than the groove of the flange, an outer flange portion provided on a side of the groove of the flange opposite the winding core, and an electrode portion in which an end of the conductive wire wound around the winding core is wound in the groove. A first distance from a bottom face of the groove to at least an outer side face of the outer flange portion is shorter than a second distance from the bottom face of the groove to an outer side face of the inner flange portion.

In a more specific embodiment of the disclosure, when the first distance is shorter than a third distance from the bottom face of the groove to an outer side face of the conductive wire wound in the groove, a difference between the first distance and the third distance is smaller than a diameter of the conductive wire.

In another more specific embodiment of the disclosure, the wire-would coil is further configured to be mounted to a mounting board such that the outer side face of the outer flange portion to which the first distance is measured and the outer side face of the inner flange portion to which the second distance is measured, face the mounting board.

In yet another more specific embodiment of the disclosure, the wire-would coil is further configured to be mounted to a mounting board such that said outer side face of the conductive wire wound in the groove to which the third distance is measured faces the mount board.

In another embodiment of the disclosure, a wire-wound coil is mounted to a mount board and includes a winding core around which a conductive wire is wound, and a flange provided at each end of the wired winding core. Each flange includes a groove provided in an outer peripheral surface of the flange, an inner flange portion provided closer to the winding core than to the groove of the flange, an outer flange portion provided on a side of the groove of the flange opposite the winding core, and an electrode portion in which an end of the conductive wire wound around the winding core is wound in the groove. A first distance from a mounting surface of the mount board to an outer side face of the outer flange portion facing the mount board is longer than a second distance from the mounting surface of the mount board to an outer side face of the inner flange portion facing the mount board.

In a more specific embodiment of the disclosure, an outer side face of the conductive wire wound in the groove extends past the outer side face of the outer flange portion facing the mount board a distance smaller than a diameter of the conductive wire.

DETAILED DESCRIPTION

Figure 8:
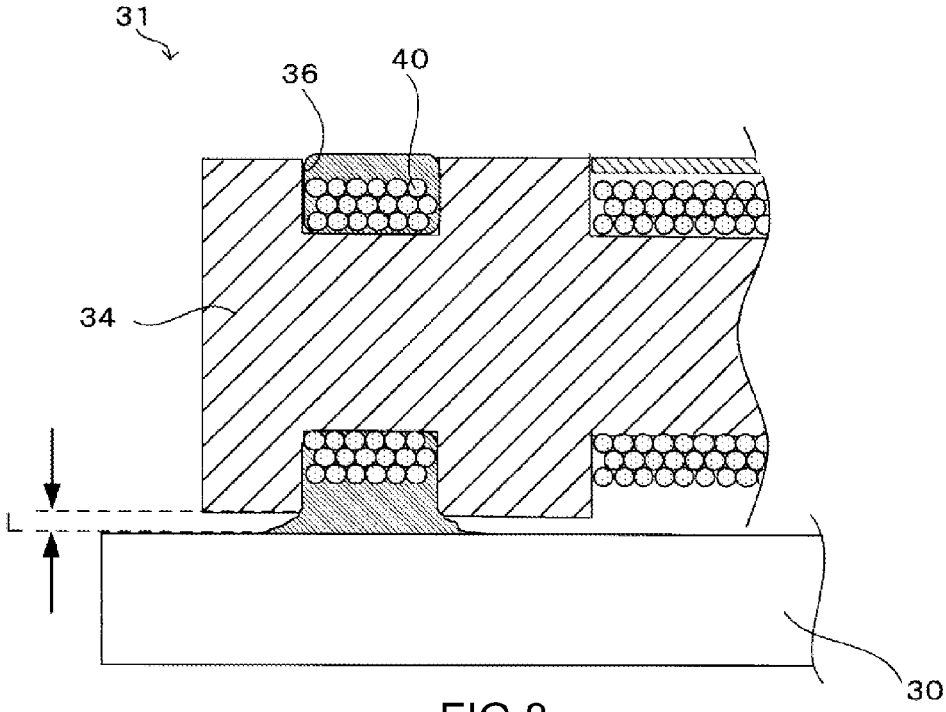
FIG.8 Prior Art
FIG. 8 is a partial sectional view of a wire-wound coil of the related art.

The inventors realized that according to the method of Patent Document 1, as illustrated in FIG. 8, in a coil component 31 mounted on a mount board 30, when a distance L between the mount board 30 and an outer side face of an outer flange portion 34 facing the mount board 30 is short, if the mount board 30 is bent by vibration due to a fall after mounting or for other reasons, the outer flange portion 34 of the coil component 31 may be broken by contact with the mount board 30, and a conductive wire 40 wound in a groove 36 may be thereby misaligned or unwound.

To address these shortcomings, the present disclosure provides a wire-wound coil that can prevent contact between an outer flange portion of the wire-wound coil and a mount board so as to prevent breakage of the outer flange portion and misalignment and unwinding of a wound conductive wire.

Figure 1:
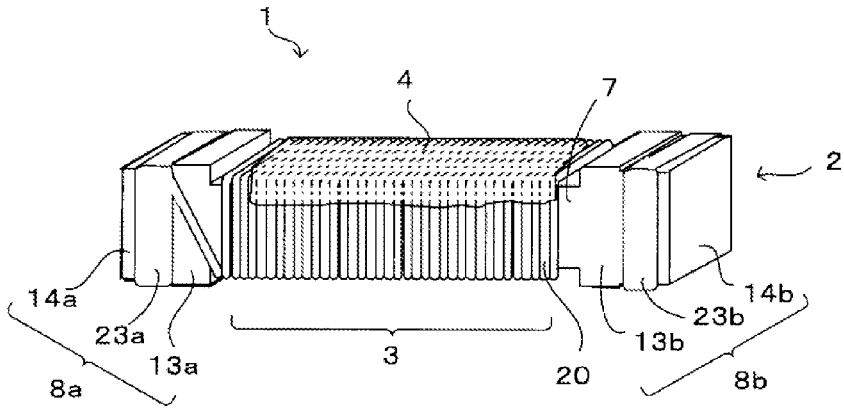
FIG. 1 is a schematic structural view of a wire-wound coil according to a first exemplary embodiment.

A first exemplary embodiment will now be described with reference to FIGS. 1 to 6. FIG. 1 is a schematic structural view of a wire-wound coil, FIG. 2 is a partial sectional view of the wire-wound coil of FIG. 1, and FIGS. 3 to 6 are explanatory views illustrating a manufacturing process for the wire-wound coil.

As illustrated in FIG. 1, the structure of wire-wound coil 1 according to the first exemplary embodiment includes a core 2, a first winding portion 3, and a resin layer 4.

The core 2 can be formed of ferrite, and includes a winding core 7 and flanges 8*a* and 8*b* provided at opposite ends of the winding core 7, as illustrated in FIG. 1. The winding core 7 can be shaped like a quadrangular prism that is long in one direction. The flanges 8*a* and 8*b* can be each shaped like a rectangular parallelepiped, and the winding core 7 and the flanges 8*a* and 8*b* can be formed integrally.

Figure 2:
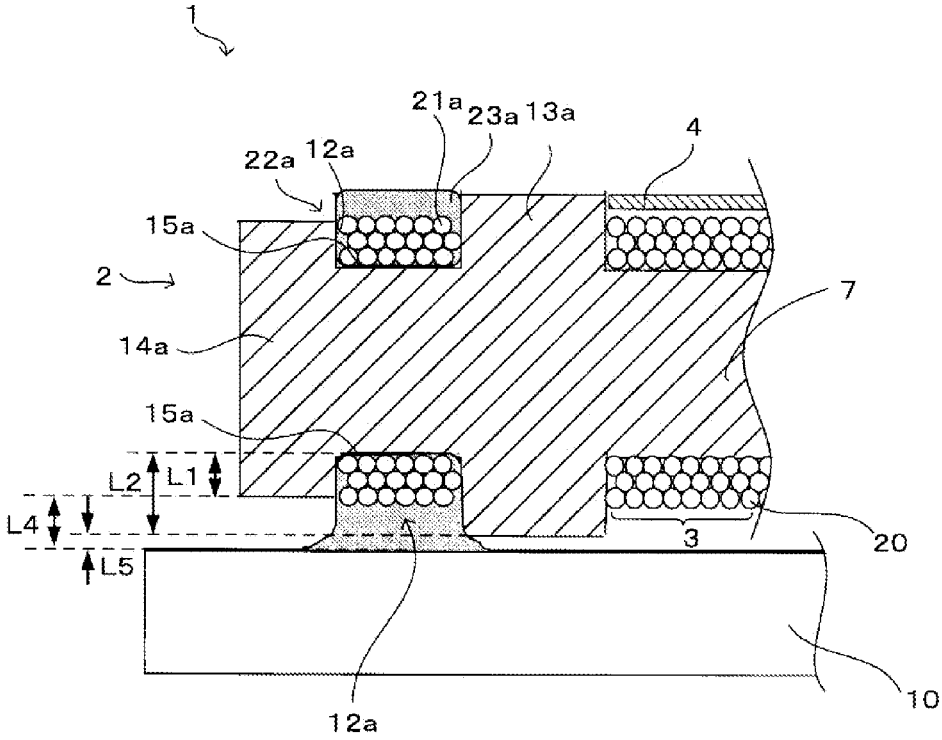
FIG. 2 is a partial sectional view of the wire-wound coil of FIG. 1.
Figure 3:
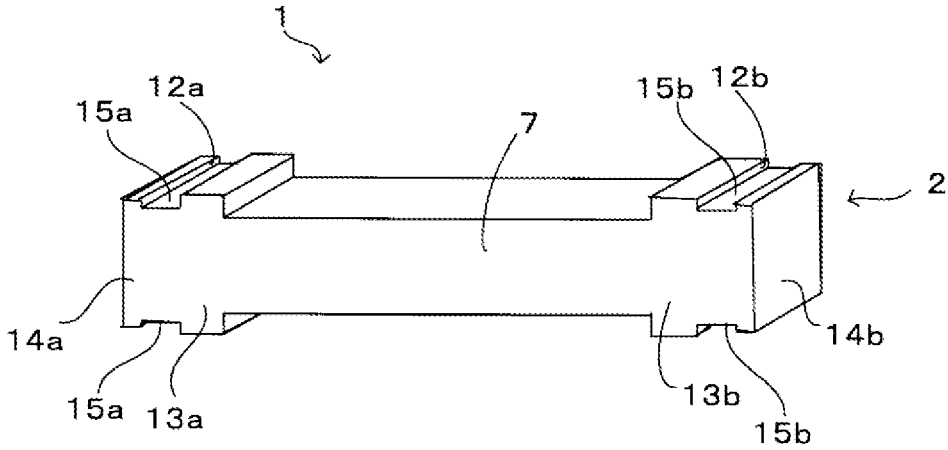
FIG. 3 is an explanatory view illustrating an exemplary manufacturing process for the wire-wound coil of FIG. 1.

FIG. 2 is a sectional view of the wire-wound coil 1 of FIG. 1 mounted on a mount board 10, taken in a direction perpendicular to the mount board 10. Since a wind ending side is similar to a wind starting side, FIG. 2 illustrates only a cross section of the wind starting side, but does not illustrate the wind ending side to simplify illustration. As illustrated in FIG. 2, lower surfaces of the flanges 8*a* and 8*b* facing the mount board 10 and upper surfaces opposite the lower surfaces are provided with grooves 12, of which groove 12*a* is shown in FIG. 2 (groove 12*b* is shown in FIG. 3). Opposite ends of the grooves 12*a* and 12*b* are respectively provided with inner flange portions 13*a* and 13*b* that protect a below-described conductive wire 20 wound around the winding core 7, and outer flange portions 14*a* and 14*b* that prevent end portions 21*a* and 21*b* (see, FIG. 4) of the conductive wire 20 wound in the grooves 12*a* and 12*b* from becoming misaligned and unwound.

As illustrated in FIG. 2, a distance L1 from bottom faces 15*a* of the grooves 12*a* to outer side faces of the outer flange portion 14*a* is shorter than a distance L2 from the bottom faces 15*a* of the grooves 12*a* to outer side faces of the inner flange portion 13*a*. In other words, a distance L4 between an outer side face of the outer flange portion 14*a* and a mounting surface of the mount board 10 is longer than a distance L5 between an outer side face of the inner flange portion 13*a* and the mounting surface of the mount board 10. The grooves 12*a* and 12*b* may be provided in surfaces of the flanges 8*a* and 8*b* other than the upper and lower surfaces.

The first winding portion 3 is formed by winding a conductive wire 20 formed of an electrically conductive material in a plurality of layers around the winding core 7. Both end portions 21*a* and 21*b* of the conductive wire 20 in the first winding portion 3 are wound in the grooves 12*a* and 12*b* of the flanges 8*a* and 8*b*, respectively, thereby forming second winding portions 22*a* and 22*b*. The second winding portions 22*a* and 22*b* are soldered to form solder electrodes 23*a* and 23*b*. Further, the solder electrodes 23*a* and 23*b* can be mounted on predetermined positions of the mount board 10 by soldering, as shown in FIG. 2. The second winding portions 22*a* and 22*b* correspond to an electrode portion of the present disclosure.

In addition, the resin layer 4 is formed of a nonconductive resin such as UV curable resin in a manner such as to cover an upper surface of the first winding portion 3. The size of the wire-wound coil 1 can be 7.4 mm×2.0 mm×1.9 mm, for example. Further, the difference between the distance L1 and the distance L2 can be about 0.15 mm, for example.

Next, an exemplary manufacturing method for the wire-wound coil 1 will be described below with reference to FIGS. 3 to 6. In FIGS. 3 to 6, the left side of the figures indicates the wind starting side of the conductive wire 20 and the right side indicates the wind ending side.

First, a core 2 is formed. A mold having a cavity worked in the same shape as the outer shape of the core 2 is prepared, and the cavity is filled with ferrite powder. Then, the ferrite powder is compressed to form a core 2 illustrated in FIG. 3. In this case, the mold having the same shape as the outer shape of the core 2 is formed such that the above-described distance L1 of upper and lower surfaces of outer flange portions 14*a* and 14*b* is shorter than the distance L2 when mounted on the mount board 10. The core 2 can be formed of materials other than ferrite.

Figure 4:
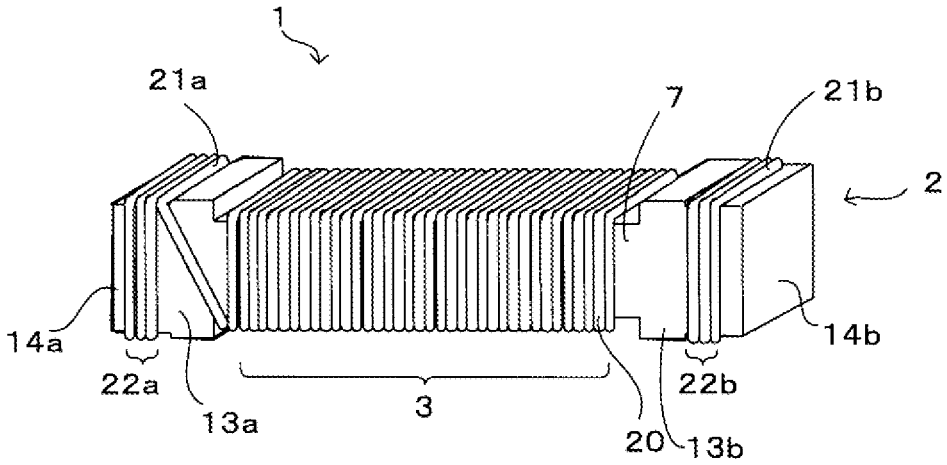
FIG. 4 is an explanatory view illustrating the exemplary manufacturing process for the wire-wound coil of FIG. 1.

Next, as illustrated in FIG. 4, a conductive wire 20 is wound around a winding core 7 of the core 2. For example, the conductive wire 20 is about 50 μm in diameter, and is wound in a plurality of layers while reciprocating between a wind starting side and a wind ending side of the winding core 7. For example, the conductive wire 20 is wound in about five layers and in 250 turns in a first winding portion 3.

Figure 5:
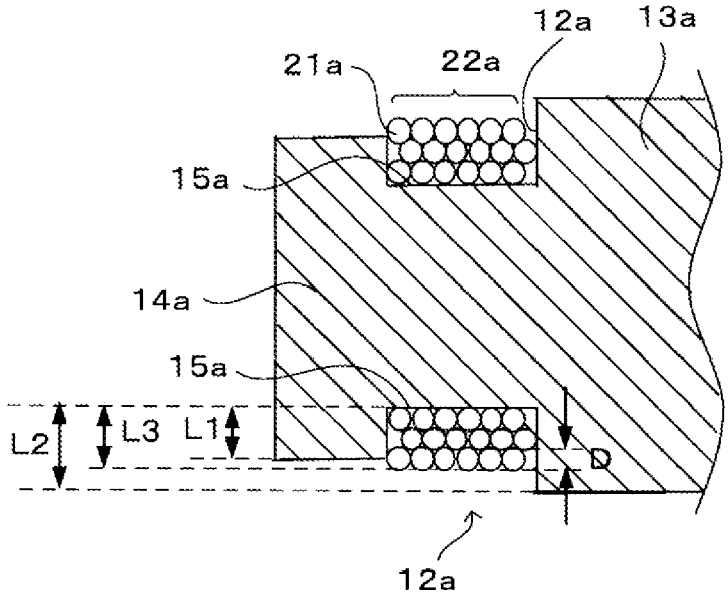
FIG. 5 is a partial sectional view illustrating the exemplary manufacturing process for the wire-wound coil of FIG. 1.

Both end portions 21*a* and 21*b* of the conductive wire 20 are wound in grooves 12*a* and 12*b* of flanges 8*a* and 8*b* to form second winding portions 22*a* and 22*b*, respectively. In this case, as illustrated in FIG. 5, a distance L3 from bottom faces 15*a* and 15*b* of the grooves 12*a* and 12*b* to outer side faces of the second winding portions 22*a* and 22*b* facing the mount board 10 can be longer than the distance L1 from the bottom faces 15*a* and 15*b* of the grooves 12*a* and 12*b* to outer side faces of the outer flange portions 14*a* and 14*b* facing the mount board 10. In this case, the end portions 21*a* and 21*b* are wound in a predetermined number of layers in the grooves 12*a* and 12*b* to form the second winding portions 22*a* and 22*b* so that the difference between the distance L3 and the distance L1 is smaller than the diameter D of the conductive wire 20. Although FIG. 5 illustrates only a cross section of the wind starting side, the wind ending side is similar to the wind starting side and is not illustrated to simplify the drawing.

Next, solder electrodes 23*a* and 23*b* are formed by solder immersion. In this process, the wire-wound coil 1 is immersed from the outer flange portion 14*a* side into a bath of heat-melted solder, and the second winding portion 22*a* provided in the grooves 12*a* is immersed in the solder. In this case, even when the wire-wound coil 1 is immersed from the outer flange portion 14*a* side in the bath of solder, the outer flange portion 14*a* prevents the second winding portion 22*a* from becoming misaligned and unwound. Then, a coating on the conductive wire 20 in the second winding portion 22*a* is detached by heat, and solder adheres to the second winding portion 22*a*.

Figure 6:
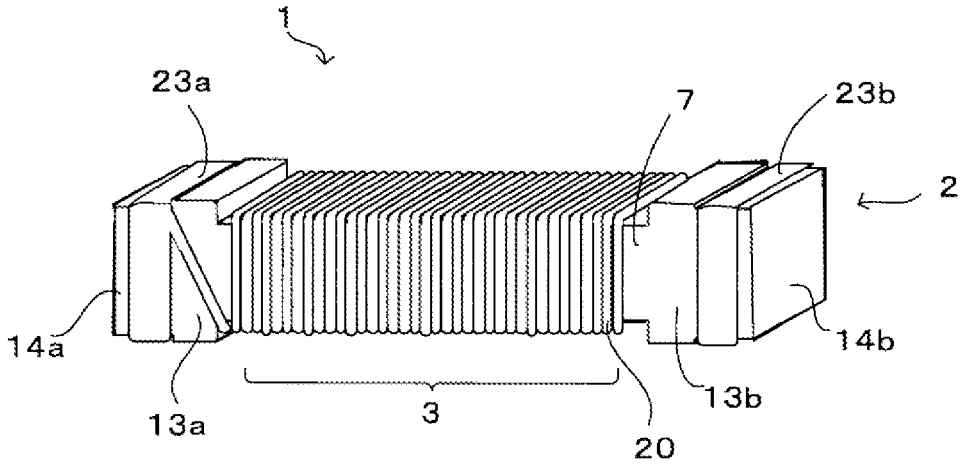
FIG. 6 is an explanatory view illustrating the exemplary manufacturing process for the wire-wound coil of FIG. 1.

After adhering solder to the second winding portion 22*a*, the wire-wound coil 1 is pulled up from the bath of solder, and the heat-melted solder is then cooled and solidified, whereby a solder electrode 23*a* is formed, as illustrated in FIG. 6. Similarly, the second winding portion 22*b* provided in the grooves 12*b* is immersed from the outer flange portion 14*b* side into the heat-melted solder to form a solder electrode 23*b*. The solder electrodes 23*a* and 23*b* can be formed by methods other than solder immersion. Further, the solder electrodes 23*a* and 23*b* can be formed of conductive materials other than solder.

After forming the solder electrodes 23*a*, 23*b*, a resin layer 5 is formed of UV curable resin on an upper surface of the first winding portion 3, and the wire-wound coil 1 illustrated in FIG. 1 is completed. The resin layer 5 can be formed of nonconductive resins other than UV curable resin.

As described above, according to the first exemplary embodiment, the distance L1 from the bottom faces 15*a* and 15*b* of the grooves 12*a* and 12*b* provided in the flanges 8*a* and 8*b* to at least the outer side faces of the outer flange portions 14*a* and 14*b* facing the mount board 10 is shorter than the distance L2 from the bottom faces 15*a* and 15*b* of the grooves 12*a* and 12*b* to the outer side faces of the inner flange portions 13*a* and 13*b* facing the mount board 10. Hence, the distance L4 between the outer side faces of the outer flange portions 14*a* and 14*b* facing the mount board 10 and the mounting surface of the mount board 10 is longer than the distance L5 between the outer side faces of the inner flange portions 13*a* and 13*b* facing the mount board 10 and the mounting surface of the mount board 10. Thus, even if the mount board 10 is bent, it is prevented from contacting the outer flange portions 14*a* and 14*b*. Therefore, it is possible to prevent breakage of the outer flange portions 14*a* and 14*b* of the wire-wound coil 1 mounted on the mount board 10 and to prevent the end portions 21*a* and 21*b* of the conductive wire 20 wound in the grooves 12*a* and 12*b* from becoming misaligned and unwound.

Further, in a case in which the distance L1 is shorter than the distance L3 from the bottom faces 15*a* and 15*b* of the grooves 12*a* and 12*b* to the outer side faces of the second winding portions 22*a* and 22*b* facing the mount board 10, and the difference between the distance L1 and the distance L3 is smaller than the diameter of the conductive wire 20, the end portions 21*a* and 21*b* of the conductive wire 20 wound in the grooves 12*a* and 12*b* can be prevented from unwinding. Therefore, it is possible to increase the distance between the mount board 10 and the outer side faces of the outer flange portions 14*a* and 14*b* facing the mount board 10 while preventing the end portions 21*a* and 21*b* from unwinding.

An exemplary embodiment modified from the above-described first exemplary embodiment will now be described. In the above-described exemplary embodiment, for convenience of handling, the upper and lower surfaces of the outer flange portions 14*a* and 14*b* mounted on the mount board 10 are provided such that the distance L1 is shorter than the distance L2 in order to make the core 2 symmetrical in the up-down direction. As long as at least the outer side faces (lower surfaces) of the outer flange portions 14*a* and 14*b* facing the mount board 10 are provided such that the distance L1 is shorter than the distance L2, other faces of the outer flange portions 14*a* and 14*b* do not always need to be provided such that the distance L1 is shorter than the distance L2.

Figure 7:
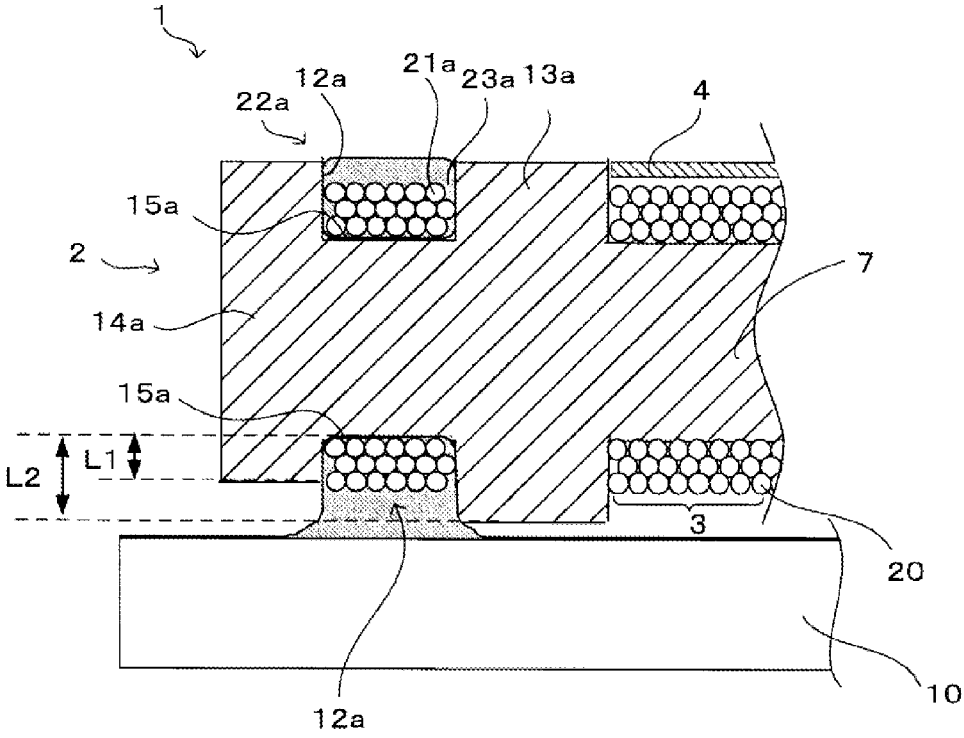
FIG. 7 is a partial sectional view of a wire-wound coil according to a modification of the first exemplary embodiment.

For example, as illustrated in FIG. 7, only the outer side faces of the outer flange portions 14*a* and 14*b* facing the mount board 10 may be provided such that the distance L1 is shorter than the distance L2. In this case, the mold used to form the core 2 is preferably shaped such that the distance L1 is shorter than the distance L2. While FIG. 7 illustrates only a cross section of the wind starting side, it is to be appreciated that the wind ending side is similar to the wind starting side, and thus is not illustrated to simplify the drawing.

Embodiments of the disclosure are not limited to the above-described embodiment, and various modifications other than the above can be made without departing from the scope.

For example, while the conductive wire 20 is wound in a horizontal manner such as to be wound in a direction parallel to the mount board 10 in the above-described embodiments, it can be wound in a vertical manner such as to be wound perpendicularly to the mount board 10.

Additionally, while the winding core 7 is shaped like a quadrangular prism that is long in one direction in an above-described embodiment, it can be columnar or can have other shapes. The shape of the flanges 8*a* and 8*b* is not limited to the rectangular parallelepiped shape, and can be other shapes such as an inverse U-shape in side view. Further, the grooves 12*a* and 12*b* can be annularly provided in the flanges 8*a* and 8*b*. In addition, in the grooves 12*a* and 12*b*, the bottom faces and the walls do not always need to be perpendicular to each other, and, for example, the bottom faces of the grooves can be curved or may have a cutout or a projection.

In embodiments of a wire-wound coil where a first distance from a bottom face of a groove provided in a flange to at least an outer side face of an outer flange portion facing a mount board is shorter than the second distance from the bottom face of the groove to an outer side face of an inner flange portion facing the mount board, the distance between the mount board and the outer side face of the outer flange portion facing the mount board increases. Thus, even when the mount board is bent, the outer flange portion can be prevented from contacting the mount board. Therefore, it is possible to prevent breakage of the outer flange portion of the wire-wound coil mounted on the mount board and to prevent the end of the conductive wire wound in the groove from becoming misaligned and unwound.

In embodiments of a wire-wound coil where the first distance is shorter than a third distance from the bottom face of the groove to the outer side face of an electrode portion facing the mount board, and the difference between the first distance and the third distance is smaller than the diameter of the conductive wire, the conductive wire wound in the groove can be prevented from unwinding. Therefore, it is possible to increase the distance between the mount board and the outer side face of the outer flange portion facing the mount board while preventing the conductive wire wound in the groove from unwinding.

Additionally, in embodiments of a wire-wound coil where a fourth distance from a mounting surface of the mount board to the outer side face of the outer flange portion facing the mount board is longer than a fifth distance from the mounting surface of the mount board to the outer side face of the inner flange portion facing the mount board, even when the mount board is bent, the outer flange portion can be prevented from contacting the mount board. Therefore, it is possible to prevent breakage of the outer flange portion of the wire-wound coil mounted on the mount board and to prevent the end of the conductive wire wound in the groove from becoming misaligned and unwound.

Embodiments of the present disclosure are applicable to a wire-wound coil serving as an antenna incorporated in a hearing aid, a mobile telephone, etc. or an electronic apparatus used for denoising.

It should be understood that the above-described embodiments are illustrative only and that variations and modifications will be apparent to those skilled in the art without departing from the scope and spirit of the disclosure. The scope of the present invention should be determined in view of the appended claims and their equivalents.

The invention claimed is:

1. A wire-wound coil including a winding core around which a conductive wire is wound, and a flange provided at each end of the winding core, the wire-wound coil being mountable on a mount board, wherein each flange includes:

a groove provided in an outer peripheral surface of the flange;

an inner flange portion provided closer to the winding core than the groove of the flange;

an outer flange portion provided on a side of the groove of the flange opposite the winding core; and an electrode portion in which an end of the conductive wire wound around the winding core is wound in the groove, wherein a first distance from a bottom face of the groove to at least an outer side face of the outer flange portion is shorter than a second distance from the bottom face of the groove to an outer side face of the inner flange portion.

2. The wire-wound coil according to claim 1, wherein, when the first distance is shorter than a third distance from the bottom face of the groove to an outer side face of the conductive wire wound in the groove, a difference between the first distance and the third distance is smaller than a diameter of the conductive wire.

3. The wire-would coil of claim 1, wherein the wire-would coil is further configured to be mounted to a mounting board such that said outer side face of the outer flange portion to which the first distance is measured and said outer side face of the inner flange portion to which the second distance is measured, face the mounting board.

4. The wire-would coil of claim 2, wherein the wire-would coil is further configured to be mounted to a mounting board such that said outer side face of the outer flange portion to which the first distance is measured and said outer side face of the inner flange portion to which the second distance is measured, face the mounting board.

5. The wire-would coil of claim 2, wherein the wire-would coil is further configured to be mounted to a mounting board such that said outer side face of the conductive wire wound in the groove to which the third distance is measured faces the mount board.

6. A wire-wound coil including a winding core around which a conductive wire is wound, and a flange provided at each end of the winding core, the wire-wound coil mounted on a mount board, wherein each flange includes:

a groove provided in an outer peripheral surface of the flange;

an inner flange portion provided closer to the winding core than the groove of the flange;

an outer flange portion provided on a side of the groove of the flange opposite the winding core; and an electrode portion in which an end of the conductive wire wound around the winding core is wound in the groove, wherein a first distance from a mounting surface of the mount board to an outer side face of the outer flange portion facing the mount board is longer than a second distance from the mounting surface of the mount board to an outer side face of the inner flange portion facing the mount board.

7. The wire-wound coil according to claim 6, wherein an outer side face of the conductive wire wound in the groove extends past the outer side face of the outer flange portion facing the mount board a third distance smaller than a diameter of the conductive wire.

* * * * *